US011814260B2

(12) United States Patent
Boerma

(10) Patent No.: US 11,814,260 B2
(45) Date of Patent: Nov. 14, 2023

(54) DEVICE FOR CONVEYING FLAT PIECES

(71) Applicant: IAI industrial systems B.V., Veldhoven (NL)

(72) Inventor: Erik Niels Boerma, Eindhoven (NL)

(73) Assignee: IAI industrial systems B.V., Veldhoven (NL)

( * ) Notice: Subject to any disclaimer, the term of this patent is extended or adjusted under 35 U.S.C. 154(b) by 0 days.

(21) Appl. No.: 17/649,622

(22) Filed: Feb. 1, 2022

(65) Prior Publication Data

US 2022/0380154 A1 Dec. 1, 2022

(30) Foreign Application Priority Data

Jun. 1, 2021 (EP) ..... 21177050

(51) Int. Cl.
*B65H 5/22* (2006.01)
*B65H 29/24* (2006.01)

(52) U.S. Cl.
CPC ..... *B65H 5/224* (2013.01); *B65H 2406/3221* (2013.01); *B65H 2406/3223* (2013.01); *B65H 2406/361* (2013.01); *B65H 2701/1914* (2013.01)

(58) Field of Classification Search
CPC .... B65H 5/224; B65H 11/005; B65H 29/242; B65H 2406/3223; B65H 2406/3221; B65H 2406/32231; B65H 2406/332; B65H 2406/322; B41J 11/0085; B41J 11/007
See application file for complete search history.

(56) References Cited

U.S. PATENT DOCUMENTS

| | | | | |
|---|---|---|---|---|
| 5,139,253 | A | 8/1992 | Bohme et al. | |
| 6,254,092 | B1 | 7/2001 | Yraceburu et al. | |
| 2012/0024664 | A1* | 2/2012 | Herrmann | B65H 5/224 198/471.1 |
| 2015/0336406 | A1* | 11/2015 | Hobo | B65H 5/224 347/104 |
| 2018/0280241 | A1* | 10/2018 | Okabe | B41J 3/407 |
| 2020/0361225 | A1* | 11/2020 | Escudero Gonzalez | B41J 11/06 |

FOREIGN PATENT DOCUMENTS

EP 1698578 A2 9/2006

OTHER PUBLICATIONS

"European Application Serial No. 21177050.8, Extended European Search Report dated Nov. 22, 2021", 7 pgs.

* cited by examiner

*Primary Examiner* — Luis A Gonzalez
(74) *Attorney, Agent, or Firm* — Schwegman Lundberg & Woessner, P.A.

(57) ABSTRACT

The present application relates to a device for conveying flat pieces. The device comprises a belt with a transport surface, wherein the belt is movable along a transport axis; a support element with a support surface for supporting the belt; and a vacuum supply for providing vacuum suction; wherein a suction distributing structure at the support surface of the support element is in fluid connection with the vacuum supply; and wherein the suction distributing structure has a belt suction region and a card suction region, wherein the belt suction region is configured to provide suction to the belt and the card suction region is configured to provide suction to flat pieces on the transport surface of the belt. The present application also relates to a system for treating flat pieces, the system comprising a treatment device, for example a print head.

10 Claims, 7 Drawing Sheets

DEVICE FOR CONVEYING FLAT PIECES

Figure 1:
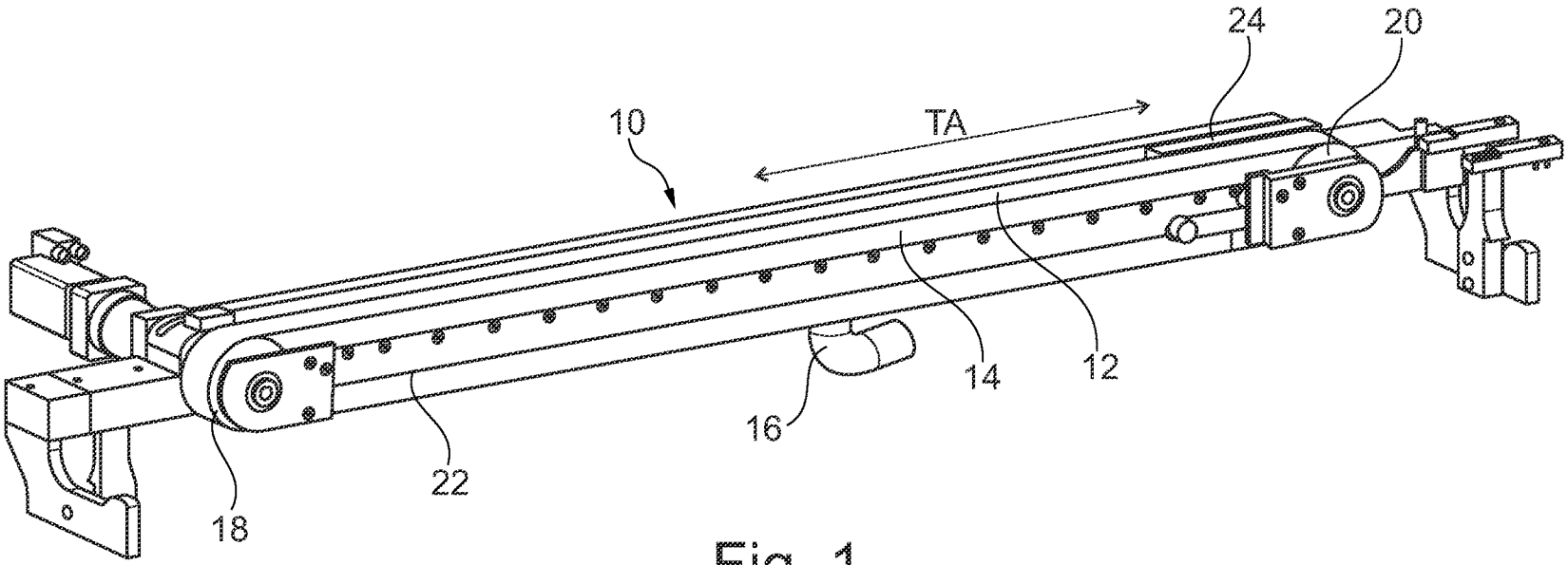

The present application claims the benefit of priority to European Appl. No. 21177050.8, titled "Device for Conveying Flat Pieces," filed Jun. 1, 2021, which is hereby incorporated by reference herein in its entirety.

The present invention relates to a device for conveying flat pieces, in particular a device for conveying plastic cards. Also, the invention relates to a printer for flat pieces, in particular plastic cards.

Producing and treating flat pieces, such as plastic cards, has gained a high importance. There are many applications for plastic cards, for example ID cards and cards for implementing security features. One of the recurring challenges is to treat such cards automatically. For example, printing with different cards and even with a mix of different printing and engraving techniques requires high precision and reproducibility. This turns out problematic for the known systems for automatic and high-throughput handling of cards.

In some devices, a conveyor belt is used to transport cards from a supply end to treatment devices, and towards an output end, where the finished cards are collected or forwarded for further treatment. In order to secure high precision applications, the cards have to be held in a defined position with low tolerances for spatial variations. On the other hand, some treatments like curing a card or mechanical manipulations may pose additional challenges to mechanisms for holding cards, for example when the cards experience mechanical deformation or strain.

In some systems, vacuum suction is employed to hold cards on the belt, which is then moved through a setup of devices for treating the cards. Such vacuum systems have been found inefficient and not sufficiently reliable to fulfill the requirements for high-precision treatment.

It is the problem of the invention to provide a device for conveying flat pieces, in particular a device for conveying plastic cards, that allows reliable operation on the cards.

This problem is solved by a device according to claim 1 of the attached set of claims. Further advantageous embodiments are given in the dependent claims.

The device for conveying flat pieces comprises a belt with a transport surface, wherein the belt is movable along a transport axis. The device also comprises a support element with a support surface for supporting the belt, and a vacuum supply for providing vacuum suction. A suction distributing structure at the support surface of the support element is in fluid connection with the vacuum supply. Herein, the suction distributing structure has a belt suction region and a card suction region. Herein, the belt suction region is configured to provide suction to the belt, and the card suction region is configured to provide suction to flat pieces on the support surface of the belt.

In particular, the belt suction region and the card suction region are configured as distinct regions at the support surface. The belt and card suction region may correspond to regions of the belt, for example a continuous region without openings in the belt and a region with openings, respectively.

In particular, the belt suction region and the card suction region are defined as regions relative to the width of the support surface and extending along the transport axis of the device. In other words, the regions are forming longitudinal stripes on the support surface of the support element.

For example, the belt suction region and card suction region each extend over at least 10% of the total width of the support surface. Also, the belt suction region and the card suction region may each have widths of at least 10% of the total width of the belt.

For example, the belt suction region may be a low-resistance region, and the card suction region may be a high-resistance region.

In an embodiment, the fluid connection with the vacuum supply in the belt suction region or low-resistance region has a lower flow resistance than in the card suction region or high-resistance region.

Thus, the device can convey and transport flat pieces reliably and with advantageously high precision. Also, the mechanism for conveying and holding a flat piece does not interfere with the treatment processes, e.g., through an air flow across the flat pieces due to pressure loss and leakage air flow.

In particular, the transport surface of the belt may be covered to different degrees with flat pieces. In two extreme cases, the covered area of the belt's transport surface may vary between a full coverage and no flat pieces covering the belt. For example, when the device is started and one flat piece after the other is loaded onto the transport surface, the transport surface is covered more and more. On the other hand, when the flat pieces are removed from the transport surface without feeding new flat pieces onto the belt, less and less surface is covered. Also, a spacing between flat pieces on the belt may be variable. In common systems, this constitutes a major problem, since air leakage of the vacuum system arises in areas that are not covered by flat pieces.

It is one central idea of the invention to provide specific structures to distribute the vacuum suction for specific purposes: One region of the suction distributing structure, the belt suction region, is provided for holding the belt in close contact to the support surface of the support element; this is in particular achieved by a low-resistance region, in which a sufficient suction force is provided by a relatively low flow resistance. Another region of the suction distributing structure, the card suction region, is provided for holding the flat piece or card relative to the transport surface of the belt; this is in particular a high-resistance region, in which relatively low air flow is induced, when a part of the belt is not covered by a flat piece. At the same time, sufficient suction force is provided and exerted on the flat pieces on the belt.

Thus, the leakage and intake of air through the suction distributing structure may be reduced by providing a high flow resistance in areas, where flat pieces are held and where more leakage may be expected. On the other hand, a lower flow resistance may be provided in areas, where the belt is held on the support surface.

In particular, the belt may be configured as a metal conveyor belt. In further examples, the belt may be made of a polymer material or it may comprise different materials.

The belt may be formed as a continuous structure, or it may have segments. A segmented belt may have joints between individual segments, which connect the segments rotatably around an axis, in particular an axis perpendicular to the transport axis.

When the device is operated, the belt or a section of the belt is constantly present above the support surface; therefore, a loss of vacuum suction can be reduced by providing a continuous belt area above a corresponding region of the suction distributing structure, in particular above a low-resistance region.

In particular, the belt, or at least a transport section of the belt that is used for conveying flat pieces, is in direct contact with the support surface, when the device is operated.

The belt may be moved continuously during operation of the device. For example, rollers at opposing ends of the device can be used to move the belt, e.g., as in conveyor belts known in the art. The belt may be configured as a loop, and the rollers may be configured to move this loop such that the belt can be used for the infinite transport of flat pieces in a transport region.

Also, during operation, flat pieces may be present at specific positions of the belt or not, thus leaving regions of the belt uncovered eventually; therefore, a region of the suction distributing structure is configured to minimize loss of vacuum suction, if a corresponding opening in the belt is not covered, and to provide sufficient vacuum suction, if the opening is covered by a flat piece. This is reached by a card suction region in the respective areas, for example a high-resistance region with higher flow resistance.

Suction is provided by creating a pressure gradient from an atmospheric pressure surrounding the device towards a lower pressure or vacuum, which is typically provided by means of a vacuum pump.

For example, the vacuum supply may be configured as a part of the support element or it may comprise a port for connecting a vacuum pump to the device.

In particular, the belt suction region, or low-resistance region, is configured to provide suction such that the belt is held in contact with the support surface, and the card suction region, or high-resistance region, is configured to provide suction to hold the flat pieces on the belt.

Herein, flow resistance may be considered a property of a channel or structure for conducting an air flow. Herein, at the same pressure gradient, a low flow resistance leads to a higher air flow compared to a lower air flow through a structure with a high flow resistance.

In an embodiment, the belt has openings that are configured such that, when the device is operated, the openings are arranged corresponding to the card suction region, in particular a high-resistance region, of the suction distributing structure. In particular, there are no openings or only openings with a small area in a region of the belt that corresponds essentially to the belt suction region, in particular a low-resistance region, of the suction distributing structure.

In particular, the openings are configured with a specific arrangement and/or form.

The openings of the belt may further be configured such that a fluid communication is established between the suction distributing structure and a region above the opening. In particular, suction is applied to a flat piece in contact with the transport surface of the belt and extending over an opening.

Openings of the belt may be arranged in a lateral edge region, e.g. within 20% of a total width of the transport surface. Also, the card suction region, or high-resistance region, may be arranged at the edge of the support surface, in particular at both opposing edges of the support surface, preferably symmetrically in the edge regions.

Additionally or alternatively, openings of the belt may be provided in a center region relative to the width of the transport surface, e.g., spanning 30% of the total width of the belt. In this case, the card suction region may be arranged at the center region of the support surface.

In an embodiment, the openings in the central region of the belt width are larger than openings in lateral regions. In many cases, the central openings are most important for efficiently holding the flat pieces. Deformations and irregularities of a flat piece, which lead to a tendency of the flat piece to loose contact to the transport surface, are typically most prominent in the central region.

Also, the belt may have at least one continuous region, i.e. a region without openings. In such a continuous region, suction can be supplied from the suction distributing structure at the support surface to the belt, but not to flat pieces above this region. The continuous region may span for example at least 20% of the total width of the belt. In particular, two continuous regions may be provided symmetrically lateral to a central region with openings in the belt.

In an embodiment, the openings are configured such that they have a pattern with periodic units, which repeat periodically along the transport axis. Herein, the periodic units are configured such that at least one opening of the periodic unit is arranged in fluid connection with the vacuum supply, while the belt is transported over the transport element. Periodic units may be arranged following after each other or overlapping.

In particular, the periodic units are arranged to be brought into fluid connection with the vacuum source via the high-resistance region of the suction distributing structure.

Thus, the openings of a periodic unit can be configured to hold flat pieces constantly. In particular, the length of a periodic unit, measured along the transport axis, may be configured such that it corresponds to not more than ⅓ of a length of a flat piece to be used with the device. Thus, when the device is operated and a flat piece is arranged on the transport surface, at least three openings covered by the flat piece are in fluid connection with the suction distributing structure; thus, a maximum of three openings may be disconnected from the suction distributing structure, while a plurality of further openings are connected to the suction distributing structure. Thus, an optimal suction and holding force are provided to a flat piece above the openings.

In an embodiment, the belt has a continuous region, which is arranged, when the device is operated, corresponding to the belt suction region of the suction distributing structure.

Herein, a continuous region of the belt may be configured without openings.

In particular, the suction distributing structure is configured such that a low-resistance region and a high-resistance region are formed on the support surface. In particular, the low-resistance region may be arranged within the belt suction region. Correspondingly, the belt may be configured such that it is continuous above this region, i.e., the belt has no openings in this area. On the other hand, the high-resistance region may be arranged within the card suction region. Correspondingly, the belt may have openings above this region, which are configured to provide suction for a flat piece that is placed on the transport surface on the belt and over a part of the card suction region. The suction is transferred via openings in the belt, corresponding to openings above the card suction region.

Also, it is possible that there are fewer or smaller openings in the belt above the belt suction region, compared to openings above the card suction area. Thus, suction can be applied to a flat piece covering an opening in this region, while at the same time reducing the resulting pressure loss, when openings are currently not covered by a flat piece.

In an embodiment, the vacuum supply comprises a closed channel in the support element along the transport axis. Thus, the vacuum may be supplied along the length of the support element along the transport axis.

A closed channel may have a longitudinal extension, where it has a surrounding channel wall. The closed channel may have a first and second end, where it is open for a fluid flow, in particular for an air flow. Also, the closed channel has a cross-section perpendicular to a longitudinal extension.

In an embodiment, the suction distributing structure comprises an open channel with a cross-section area, which is perpendicular to the support surface. In general, a smaller cross-section area leads to a higher flow resistance than a larger cross-section area, when the open channel is covered and an air flow is flowing through the open channel in a direction parallel to the support surface. Thus, the cross-section area is lower in the card suction region, or high-resistance region, than in the belt suction region, or low-resistance region.

An open channel may comprise a groove or deepening in the support surface. In contrast to a "closed" channel, an "open" channel may extend along a channel length, where it is not fully surrounded by a channel wall, but where at least one side is open towards the top of the support surface. Thus, the open channel extends over a defined area within the plane of the support surface.

When this open channel area at the transport surface is covered by the belt or by a flat piece above an opening of the belt, the vacuum supply may be connected to a resulting volume and suction is generated in the area above the open channel.

In particular, the open channel and the underside of the belt may define a volume, and suction is provided to hold the belt, when fluid has been removed from this volume. Also, the open channel, an opening of the belt and a flat piece above the opening may define a volume, and suction is provided to the flat piece, when fluid has been removed from this volume. Thus, the properties of the open channel structures defines how suction is provided to the belt or the flat pieces, and how air leakage is encountered through uncovered holes of the belt.

A defined time interval is needed for building up suction in a volume between the support surface and the belt or a flat piece. This time interval depends on the under-pressure supplied by the vacuum supply, the size of the volume and the flow resistance for removing air from the volume. In order to build up suction quickly, shallow deepenings are used for the suction distributing structure to reduce the volume.

In a region, where the belt has openings and only some openings are covered by flat pieces, smaller structures are used to further reduce the volume. Thus, when an opening is covered by a flat piece and reaches an open channel of the suction distributing structure, suction is built up very quickly. On the other hand, when an opening is not covered, the high flow resistance leads to only little air leakage flowing towards the suction distributing structure.

A "cross-section area" of an open channel may be defined as the area of a cross-section through the open channel, using the plane of the support surface of the support element as the boundary of the area, where the channel wall is open and where a belt may be positioned above the support structure. Also, an open channel may have a defined depth relative to the plane of the support surface. Also, an open channel may have a width, which is measured in a direction parallel to the plane of the support surface. In particular, a width of an open channel can be defined along a direction perpendicular to a longitudinal axis of a corresponding closed channel, which connects the open channel to the vacuum supply.

In further cases, where an open channel has a structure without a clearly defined, longitudinal extension, for example because it is round or rectangular in the top-view, an open volume may be lower in the high-resistance region than in the low-resistance region. Herein, the open volume may be defined between the opening of a fluid connection with the vacuum supply and the plane of the support surface in contact with the belt.

In an embodiment, the suction distributing structure comprises an elongated open channel in the card suction region, or high-resistance region. In particular, an open channel in the card suction region has a smaller cross-section area than in the belt suction region.

In the belt suction region, or low-resistance region, the suction distributing structure may have a greater cross-section area and/or extend over a larger area on the support surface, seen from a top view.

In an embodiment, the fluid connection of the vacuum distributing structure with the vacuum supply comprises a first closed channel with a first cross-section for supplying the belt suction region, or low-resistance region, and a second closed channel with a second cross-section for supplying the card suction region, or high-resistance region. Herein, the second cross-section is smaller than the first cross-section. Instead of the first and second cross-section area, a first and second cross-section diameter may be used to compare the channels.

Also, the second channel may comprise a plurality of separate closed channels. For example, two first channels and four second channels may be used, i.e., at a 2 to 4 ratio. In another embodiment, another ratio may be used, for example a 3 to 4 ratio.

Thus, the vacuum supply is connected to the belt suction region, or low-resistance region, of the suction distribution structure through a first channel with a larger cross-section, and thus lower flow resistance. On the other hand, the fluid connection between the vacuum supply and the card suction region, or high-resistance region, is formed by a second channel with a smaller cross-section and/or longer length, and thus higher flow resistance.

The first and second diameter may be defined as a diameter of an opening of the first and second channel, respectively, at the support surface.

In another embodiment, the first and second channel may have the same or similar cross-sections, but the first channel may have a shorter length, thus leading to a lower flow resistance in comparison to the second channel with longer length.

The first and second closed channel, connecting the vacuum supply and the suction distributing structure, may be configured as separate channels from the vacuum supply to the support surface. On the other hand, the first and second closed channel may be branches from one common fluid connection to the vacuum supply; in that case, the second closed channel can have a smaller width and/or a larger length than the first closed channel, such that the second closed channel has a higher flow resistance.

In another embodiment, different channel cross-sections may be used for the fluid connection of the low- and high-resistance region, respectively, in particular with respect to different geometric forms of the respective cross-section. By choosing suitable cross-sections, the flow resistance can be adjusted due to the respective needs.

In an embodiment, the flat pieces are plastic cards. Also, a plastic card may comprise a layered configuration, in which several layers are combined, in particular different plastic layers. In further embodiments, flat pieces can be, e.g., paper cards, metal cards or cards made of different materials, in particular composite materials.

In an embodiment, the support element is formed by at least two support element modules. These support element modules may be configured such that they can be arranged abutting each other in a longitudinal direction. Thus, it is advantageously easy to remove individual support element modules and exchange them or repair them. This is especially advantageous, if a metal belt is transported in contact with the support surface of a support element, leading to friction and wear of the contact surface.

For example, the vacuum supply may comprise a closed channel with at least one open end at one end of a support element module. In this case, when the modules are arranged with each other in the longitudinal direction, they may form a continuous closed channel and they may be sealed by gasket elements between them.

The system for treating flat pieces, in particular plastic cards, comprises a treatment device, for example a print head, in particular an inkjet print head, and a device for conveying the flat pieces according to the present disclosure. Herein, the treatment device is arranged to perform a treatment on a flat piece, in particular on the surface of a flat piece, that is conveyed by the device. Also, a plurality of treatment devices may be provided, in particular a plurality of print heads for printing different portions or parts of a print.

Figure 3:
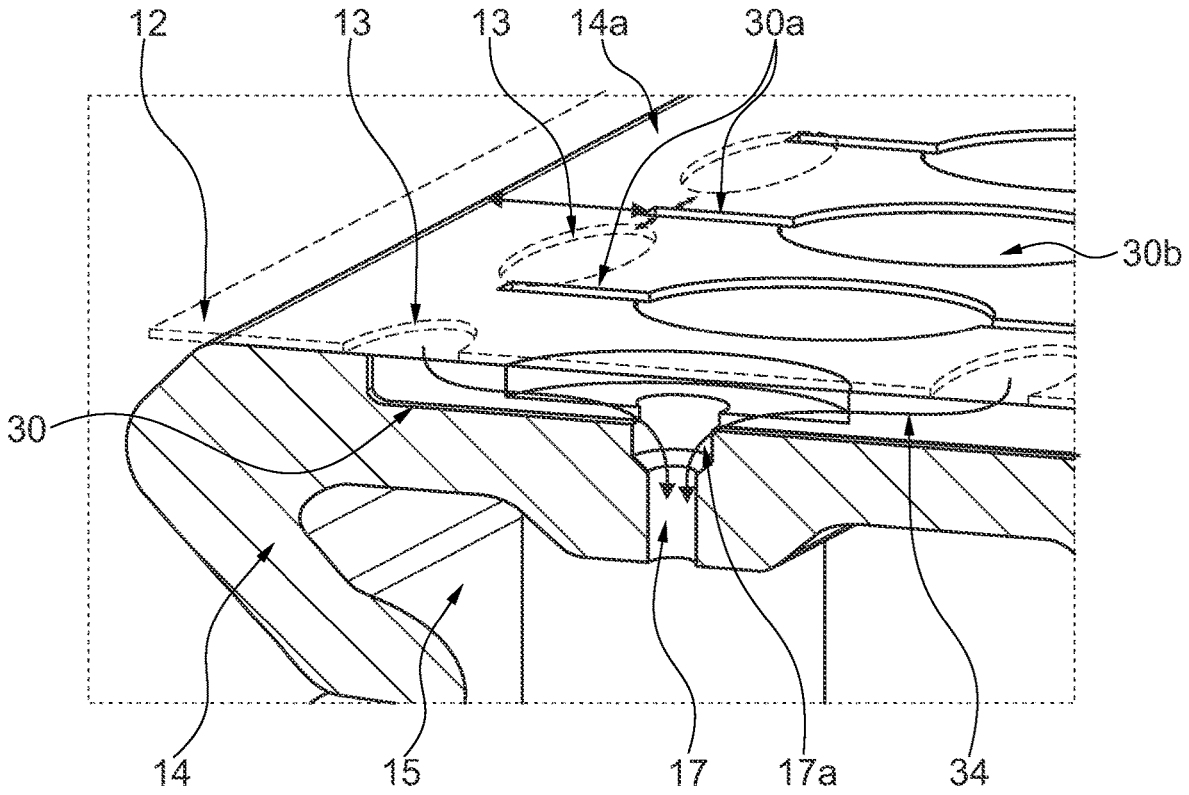
Figure 4A:
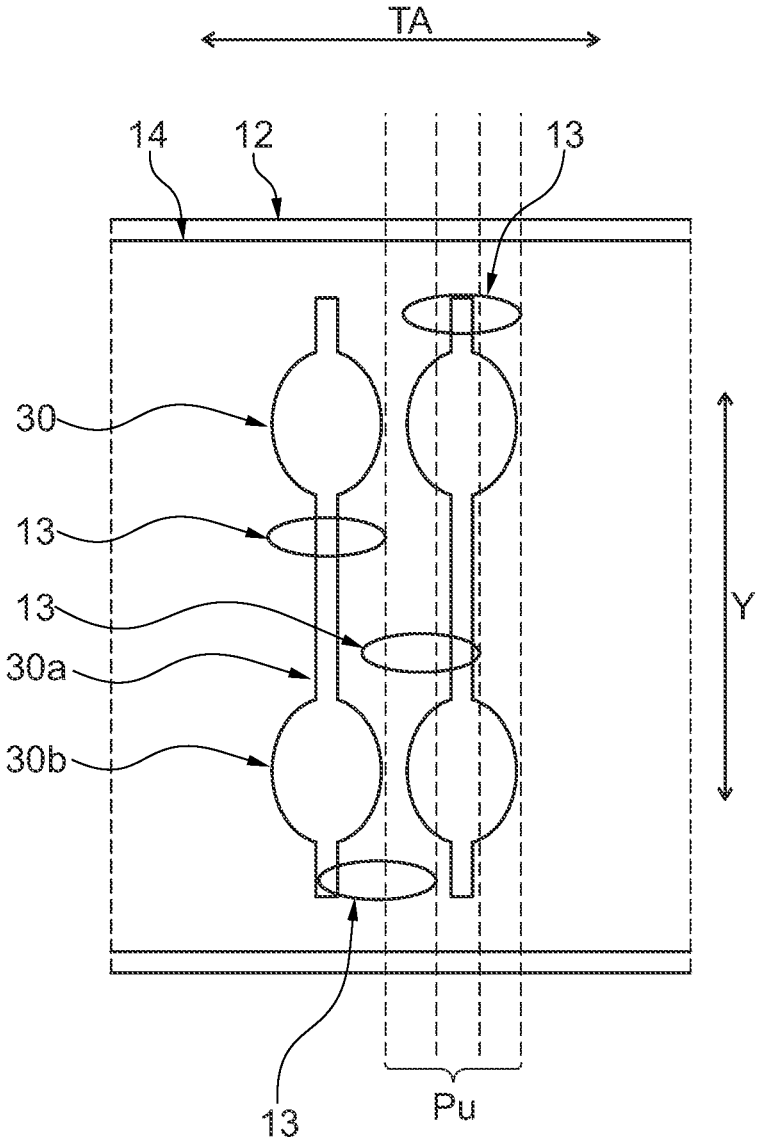
Figure 4B:
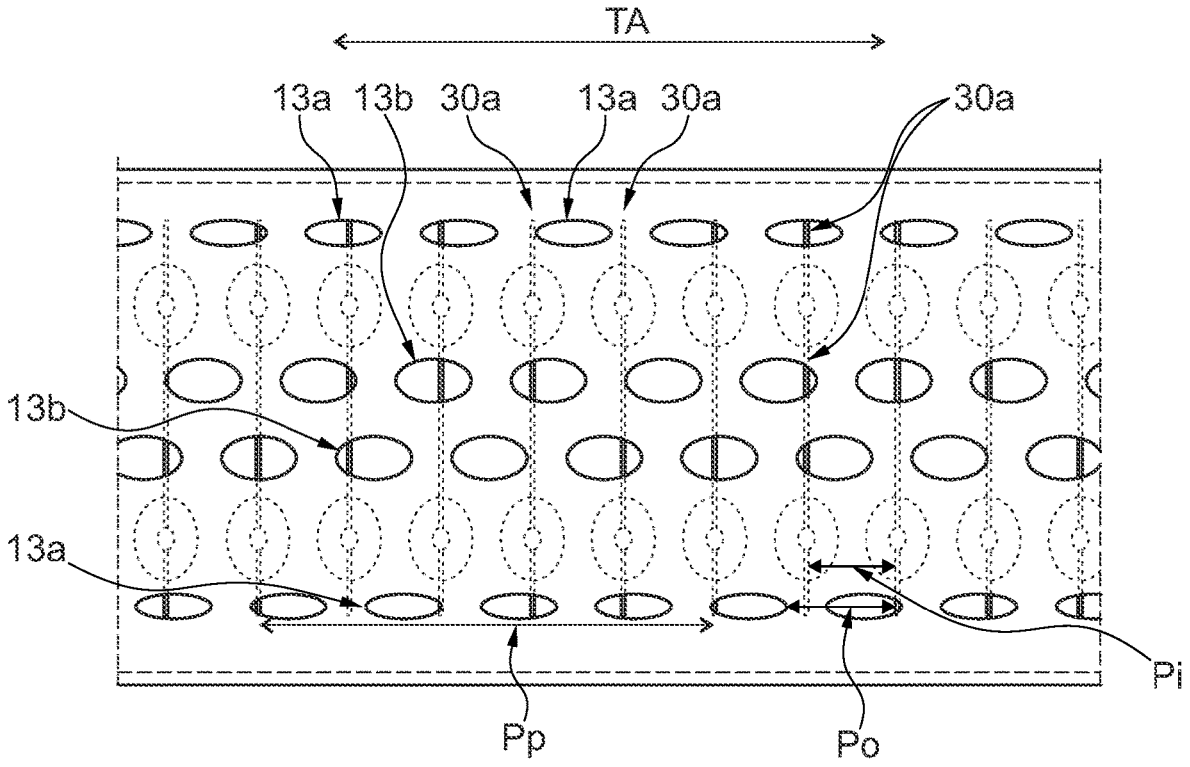
Figure 5A:
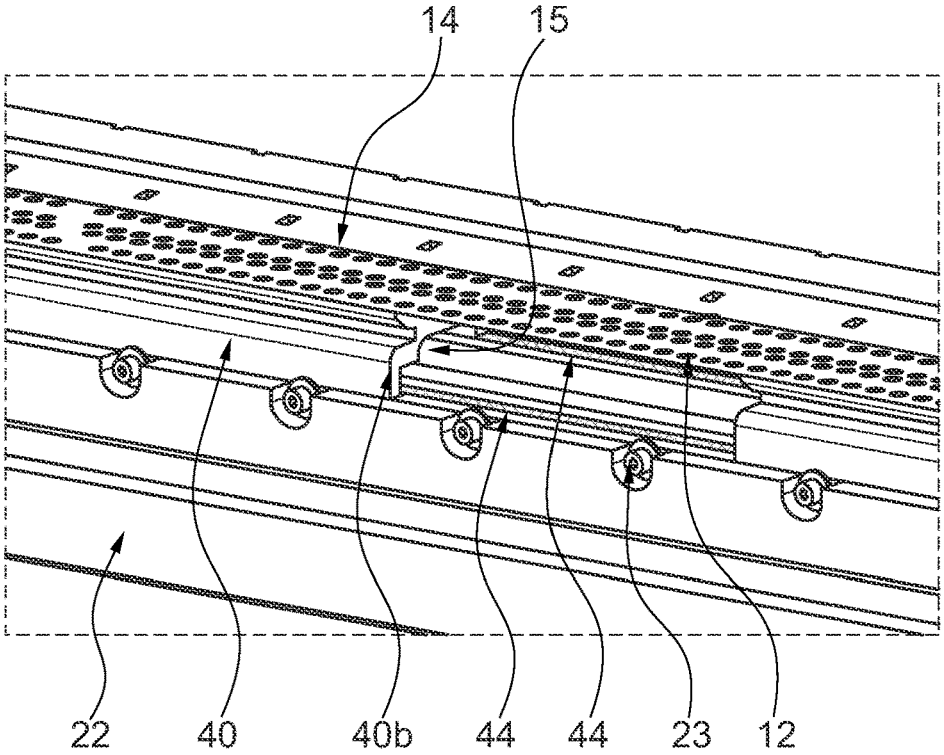
Figure 5B:
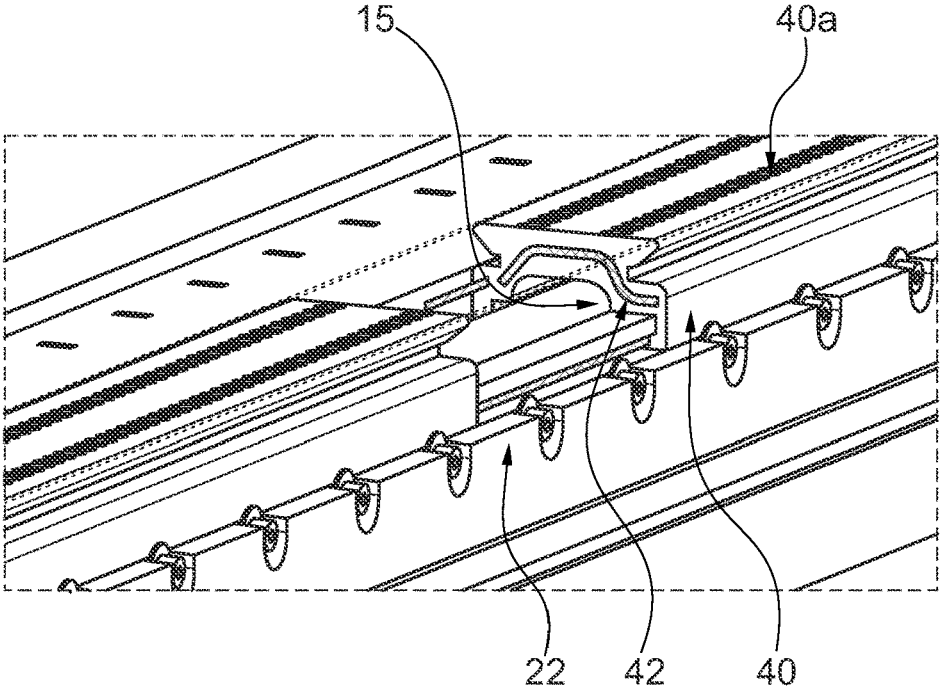

The invention is described further on the basis of the attached figures. Therein, the figures show:

FIG. 1 a perspective view of an embodiment of the device;

FIGS. 2A to 2D schematic views of details of the device;

FIG. 3 a cross-sectional view of the device;

FIGS. 4A and 4B schematic views of the suction distributing structure and the belt; and FIGS. 5A and 5B perspective views of the modular support element structure.

Turning to FIG. 1, a perspective view of an embodiment of the device is described.

The device 10 of this embodiment is part of a system for treating flat pieces 11. More specifically, the system is used to treat the plastic cards 11 by printing on them and performing other operations such as laser engraving, laminating etc. Of course, the invention is not limited to such a system.

The device 10 has a base 22, on which several other elements are mounted.

The device comprises a belt 12, which is a metal belt 12.

The metal belt 12 is configured as an endless loop and movably engaged with a driven roller 18, which is rotated by a dedicated motor unit.

At the opposite end of the device 10, a tensional idler 20 holds the belt 12 tightly. Hereby, variations of the length of the belt 12, e.g., due to temperature changes, can be compensated to avoid a loose belt 12 and to thus avoid slippage between the belt 12 and the driven roller 18.

By the driven roller 18 and the tensioned idler 20, the belt 12 is held straight along a transport axis TA and can be moved such that an object lying on the top side of the belt 12, which is configured as a transport surface 12*a*, can be transported.

In the system of the embodiment, a feed-in device is used to put a card 11 onto the belt 12 at the side of the tensioned idler 20, and the card 11 may then be transported along the transport axis TA towards the driven roller 18.

Between the driven roller 18 and the tensioned idler 20, a support element 14 is arranged. In particular, the support element 14 is positioned between a bottom part of the belt 12 and a top part of the belt 12, which is formed as a loop between the driven roller 18 and the tensioned idler 20. The top part of the loop-shaped belt 12 is supported on a top surface of the support element 14, which is configured as a support surface 14*a*.

In the present embodiment, a card ruler 24 is attached to the device 10 in proximity to the belt 12 and with an edge that is parallel to the transport axis TA. The card ruler 24 is used to ensure a proper positioning of the flat piece 11, as it glides along the parallel edge of the card ruler 24. In the embodiment, rollers are provided to push the flat piece 11 against the card ruler 24 after the flat piece 11 has been fed onto the transport surface 12*a* of the belt 12. Between the rollers and the card ruler 24, vacuum suction is built up such that a suction force is achieved to hold the flat piece 11 relative to the transport surface 12*a* of the belt 12.

In the embodiment, the support element 14 is formed with support element modules 40, as explained below with respect to FIGS. 5A and 5B.

The support element 14 of the embodiment is manufactured in a two-step process: First, additive manufacturing, in particular 3D-printing, is used to produce a raw piece of the support element 14 or its modules. Subsequently, milling and/or drilling techniques are used to produce a smooth support surface 14*a* at the top of the support element 14, and to form further structures of the support element 14, which are explained in detail below.

Within the support element 14, a channel 15 is formed, which will be explained in greater detail below. To this channel 15, a vacuum supply 16 is connected, in particular a connection to a vacuum pump.

Turning to FIGS. 2A to 2D, schematic views of details of the device are described.

Figure 2A:
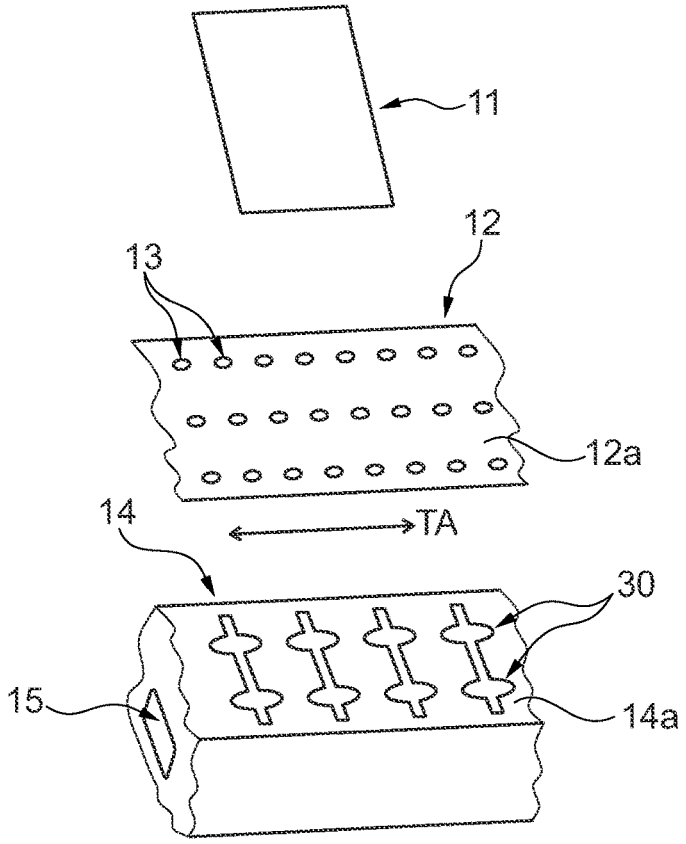

In the schematic exploded view of FIG. 2A, a card 11 is shown as the top element of the setup.

A section of the belt 12 is shown with the transport surface 12*a* on top.

The belt 12 has openings 13, which are arranged within regions at the outer edges of the belt 12 and in the middle of the belt 12.

When the device 10 is in operation, the card 11 is lying on the transport surface 12*a* of the belt 12, while the belt 12 is movable along the transport axis TA.

Below the belt 12, a section of the support element 14 is shown, with a support surface 14*a* on top.

When the device 10 is in operation, the belt 12 is in contact with the support surface 14*a* such that a certain friction is reached between the two. Such friction secures the belt 12 against displacement in a direction perpendicular to the transport axis TA.

A channel 15 is formed in the support element 14. This channel 15 is running essentially in a longitudinal direction of the support element 14, i.e., parallel to the transport axis TA.

The channel 15 is connected to the vacuum source 16, as shown above with respect to FIG. 1. Thus, a pressure below the surrounding air pressure can be generated with in the channel 15.

In further embodiments, the channel 15 can be formed between the support element 14 and the base 22. For example, complementary parts of a channel 15 may be formed in the support element 14 and the base 22, such that the channel 15 is closed, when the support element 14 is mounted on the base 22.

At the support surface 14*a* of the support element 14, a suction distributing structure 30 is formed. In general, the suction distributing structure 30 of the embodiment comprises indentations, open channels, grooves and deepened regions that are formed in the support surface 14*a*.

The suction distributing structure 30 is in fluid connection with the channel 15.

For facilitating the fluid connection, a channel 17 is used, which connects an opening in a wall of the channel 15 towards the vacuum source 16, and an opening 17*a* at the support surface 14*a*. Thus, air can be drawn from the environment into the channel 15, as long as a sufficiently low pressure is provided in the channel 15. Thus, a resulting suction extends towards the opening 17*a*, when an object is placed above the support surface 14*a* close to the opening 17*a* or the suction distributing structure 30.

When the device 10 is operated and vacuum is provided by the vacuum supply 16, suction is produced in distinct ways:

Where the belt 12 covers a part of the suction distributing structure 30, the suction is generated by this part of the suction distributing structure 30. As a result, the belt is pulled towards the support element 14.

Where an opening 13 of the belt 12 is arranged above the suction distributing structure 30, and a card 11 is covering the opening 13, the card is pulled towards the belt 12 and the support element 14.

Where an opening 13 of the belt 12 is arranged above the suction distributing structure 30, but the opening 13 is not or not completely covered by a card, surrounding gas is drawn in through the opening 13. Thus, some under-pressure in the channel 15 and suction in the suction distribution structure 30 may be lost.

Figure 2B:
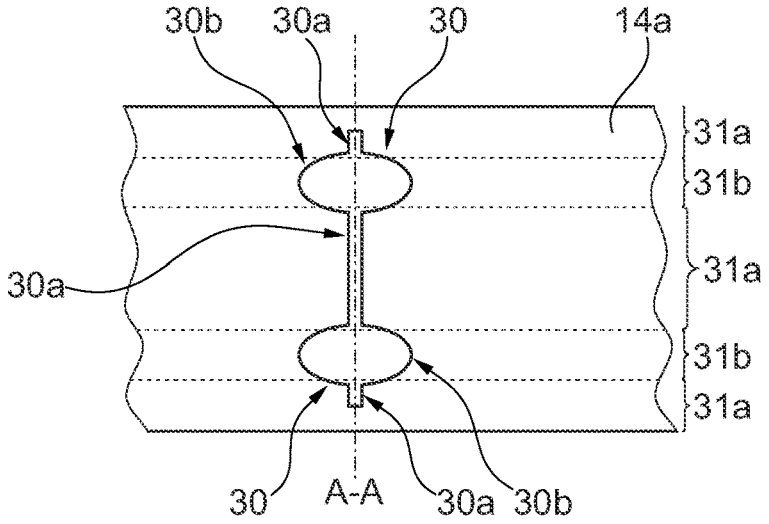

In order to prevent a too great loss of suction or under-pressure in the channel 15, the suction distribution structure 30 is formed with high-resistance structure elements 30*a* and low-resistance structure elements 30*b*. These are schematically shown in FIG. 2B.

The high-resistance structure elements 30*a* are formed such that, when they are not or only partially covered with respect to the atmospheric pressure of the environment, a fluid flow through these structure elements 30*a* is acting against a higher flow resistance than in other parts of the suction distribution structure 30. Thus, incoming fluid is drawn in relatively slowly and only a small part of the pressure gradient is lost.

Such a high flow resistance can be reached, e.g., by narrow, deep and/or long structures. Therefore, in the embodiment, the high-resistance structure elements 30*a* comprise an elongated, narrow open channel 30*a*. When an opening 13 of the belt 12 is positioned above this part of the suction distribution structure 30, and the opening 13 is not covered or only partially covered, air is sucked in, but at a relatively small rate. Also, suction may be exerted to the belt 12 in areas, where the belt material covers the narrow open channel 30*a*.

Thus, the belt 12 is configured such that the openings 13 in a region 32*a* of the belt 12 are arranged above a high-resistance region 31*a* of the support surface 14*a*. This is a card suction region 31*a*, where suction can be applied to a card 11 on the transport surface 12*a* of the belt 12. If a card 11 is present above an opening 13, it is held down by suction; if no card 11 is present, the high-resistance properties of the suction distributing structure 30 makes sure that not too much pressure is lost.

Also, it is avoided that a leakage air flow is disturbing other processes. For example, ink droplets of an inkjet printer may be considerably deflected by an air flow that is caused by uncovered openings 13, in particular in regions close to an edge of a card 11.

On the other hand, the low-resistance structure elements 30*b* are configured to provide a strong suction, since a fluid flow through these structure elements 30*b* is acting against a lower flow resistance, compared to the high-resistance structure elements 30*a*. Thus, a fluid may be sucked into the channel 15 at a higher rate than through the high-resistance structure elements 30*a*. When such a low-resistance structure element 30*b* is not or only partially covered with respect to the atmospheric pressure of the environment, a higher incoming fluid is drawn and a larger part of the pressure gradient is lost. The belt 12 is therefore configured to avoid such a situation, by providing a continuous region without openings 13.

Such a low flow resistance can be reached by wider structures. Therefore, in the embodiment, the low-resistance structure elements 30*b* comprise wide open channels 30*b* and patches, where the support surface 14*a* is deepened. In the embodiment, the belt 12 is configured such that no openings 13 are positioned above this part of the suction distribution structure 30, and a continuous region 32*b* of the belt 13 is covering these low-resistance structure elements 30*b* instead. Thus, the belt 12 itself is pulled towards the support surface 14*a* by suction in the low-resistance region 31*b*, and a belt suction region 31*a* is provided.

The effect of higher or lower flow resistance may be envisioned by an example: At the same pressure gradient, an air flow will overcome the low-resistance structure elements 30*b* with at least the double flow rate compared to a high-resistance structure element 30*a* of the suction distributing structure 30.

In another example, if a high-resistance structure element 30*a* is not covered by a flat piece 11 or the belt 12, a resulting leakage air flow through the high-resistance structure element 30*a* is lower than it would be for a low-resistance structure element 30*b*.

Figure 2C:
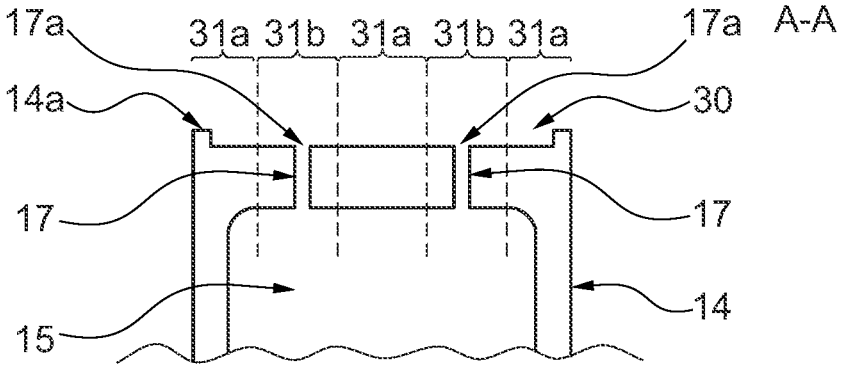

FIGS. 2B and 2C show the support element 30 from above (FIG. 2B) and in a cross-section across the plane A-A (FIG. 2C). The high-resistance regions 31*a*, which serve as card suction regions 31*a*, and the low-resistance regions 31*b*, which serve as belt suction regions 31*b*, are indicated by dotted lines.

In the cross-section of FIG. 2C, channels 17 are shown, which implement the fluid connection between the suction distributing structure 30 at the support surface 14*a* and the channel 15, which is connected to the vacuum supply 16. The channel 17 ends at the support surface 14*a* in an opening 17*a*. This opening 17*a* can be used as a vacuum control hole 17*a*, which may for example be sealable partially or totally by a mechanism to reduce suction, if needed. In particular, a cross-section area of the opening 17*a* can be adjusted or a valve can be used to configure the openings 17*a* for the predetermined properties. Also, the cross-section and/or length of the channel 17 can be adjusted such that the predetermined flow resistance is obtained. In further embodiments, more channels 17 may be provided.

In another embodiment, a high-resistance structure element 30*a* may be configured with a long and/or narrow channel 17 for fluid communication with the channel 15, which is connected to the vacuum supply 16. On the other hand, the channel 17 for a low-resistance structure element 30*b* may be wider and/or shorter. By such a configuration, the communication channel 17 itself can have a smaller or larger flow resistance. By these properties of the channel 17, similar structural configurations of the high- 30*a* and low-resistance structure elements 30*b* can be used and modified by varying the channel 17 design.

Also, the flow resistance properties of the channel 17 can be used to influence the flow resistance in addition to the properties of structure elements 30*a*, 30*b* themselves. In other words, the balance of the restrictions for the air flow through the channel 17 and the structures 30*a*, 30*b* defines a local pressure gradient and flow in situations with openings 13 covered by flat pieces 11, or openings 13 that are not covered and allow free air inflow.

Figure 2D:
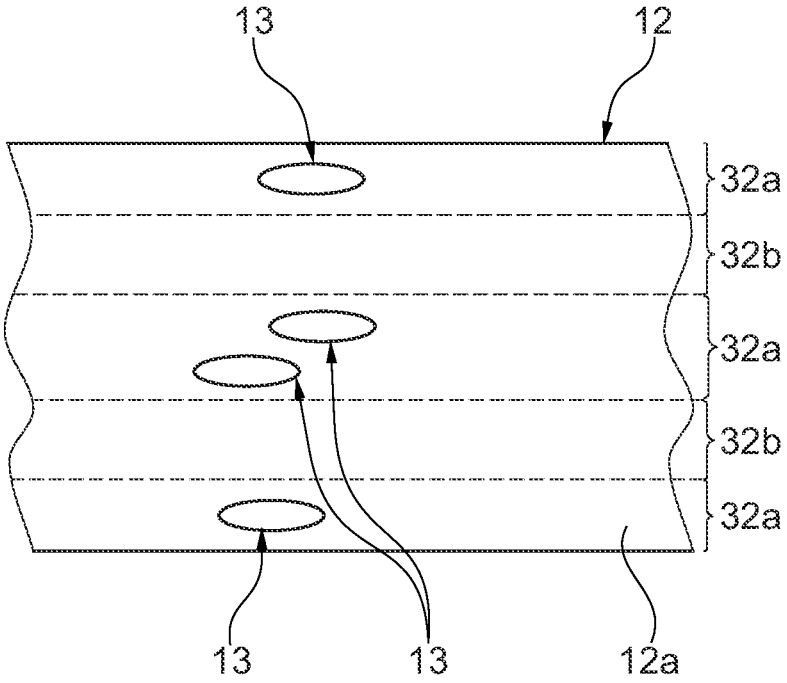

FIG. 2D shows the belt 12 of the embodiment in a schematic top view. Only some of the openings 13 are shown for clarity.

The openings 13 of the belt 12 are arranged in regions 32*a* with openings 13, while other regions 32*b* are continuous and free of openings 13. These regions 32*a*, 32*b* are defined as band-shaped regions 32*a*, 32*b* of the belt 12, running parallel to the transport axis TA.

The belt 12 is arranged on the support surface such that the regions 32*a* with openings 13 essentially coincide with the high-resistance regions 31*a* of the suction distributing structure 30. In addition to that, the continuous belt regions 32*b* essentially coincide with the low-resistance regions 31*b* of the suction distributing structure 30. Thus, the low-resistance structure elements 30*b* are always covered by the continuous belt regions 32*b*. Also, uncovered openings 13 can only occur above the high-resistance structure elements 30*a*. Thus, pressure loss and leakage air flow are reduced due to the high flow resistance, which has to be overcome by an incoming fluid.

Further details on the arrangement and configuration of openings 13 are explained below.

Referring to FIG. 3, a cross-sectional view of the support element 14 and belt 12 is shown, together with parts of a perspective view. Similar elements are shown, which have already been described above with reference to FIGS. 2A to 2D. The following description is thus focused on elements, which have not been described before in greater detail.

In the cross-section, the material of the support element 14 is shown. In the present embodiment, the support element 14 is made from a polymer material.

Above the support element's 14 top surface 14*a*, the belt 12 is arranged. While the device 10 is operated, the belt 12 glides over the top surface 14*a* of the support element 14.

The belt 12 has openings 13.

An opening 17*a* is formed at the support element's 14 top surface 14*a*, leading to a closed channel 17, where another end of the channel 17 is provided. This closed channel 17 extends downwards towards the vacuum supply 16 and another closed channel 15 within the support element 14, respectively, which distributes vacuum along the length of the support element 14.

The opening 17*a* and the closed channel 17 thus provide a fluid connection between the suction distributing structure 30, which is formed at the surface 14*a* of the support element 14, and the closed channel 15 within the support element 14, which distributes the vacuum or under-pressure along the support structure 14. Thus, an air flow 34 can enter through openings 13 of the belt 12, flow through a high-resistance 30*a* and/or a low-resistance structure element 30*b* of the suction distributing structure 30, and reach the opening 17*a*, the channel 17 and the next channel 15.

If the opening 13 is covered by a flat piece 11, suction is generated below it and a suction force is generated, pulling the flat piece 11 towards the belt and the support element 14. In the embodiment, this mechanism is mainly provided in a cooperation of the openings 13 of the belt 12 and the high-resistance structure elements 30*a*.

In a similar way, if the suction distributing structure 30 is covered by a continuous region of the belt 12, a suction force is provided to pull the belt 12 towards the support surface 14*a*. In the embodiment, this mechanism is mainly provided in a cooperation of the belt 12 and the low-resistance structure elements 30*b*.

With reference to FIGS. 4A and 4*b*, the interplay between the belt 12 and its openings 13 with the suction distributing structure 30 is described.

Herein, FIG. 4A is a more schematic view, reduced to only four openings 13 of the belt 12 and two parts of the suction distributing structure 30. FIG. 4B is a more complete view of the structure in a top-view.

As shown in FIG. 4A, the openings 13 of the belt are arranged shifted with respect to each other along the transport axis TA, which coincides with the longitudinal axis of the belt 12.

The arrangement of this set of four openings 13 is made such that it is repeated with a defined period length, resulting in a periodic unit Pu.

In the example of FIG. 4A, the openings 13 are shifted in the direction along the transport axis TA in regular distances, i.e., at shift lengths of ¼*Pu. In other embodiments, other shift lengths and/or irregular shift lengths may be used.

In the embodiment, the suction distributing structure 30 is extending essentially along an axis Y perpendicular to the transport axis TA.

It comprises high-resistance structure element 30*a*, in this example formed with larger structures like rounded pads and deepenings in the support surface 14*a*, and low resistance structure elements 30*b*, in this example formed as elongated channels along the width of the belt 12.

The belt 12 and its openings 13 are arranged such that, when the belt 12 is moved over the support surface 14*a*, the openings 13 are moved across the channels of the high-resistance structure elements 30*a*. On the other hand, a continuous region of the belt 12 is moved across the low-resistance structure elements 30*b*.

FIG. 4B shows more details of the arrangement of the belt 12 and the openings 13 formed therein, in relation to the suction distributing structure 30 of the support surface 14*a*.

In the embodiment, the openings 13 have an oval form and are longer in the longitudinal direction TA than along the width Y of the belt 12.

In this exemplary embodiment, the openings 13 are formed with different parameters, depending on their position at the lateral edges of the belt 12 or in the middle region. At the edge of the belt 12, openings 13*a* are configured with the same length along the transportation axis TA, but with smaller width, thus more elongated than openings 13*b* in the middle region. At the same time, the openings 13*a*, 13*b* have the same length along the transport axis TA. Thus, the individual openings 13*a*, 13*b* extend over a larger area in the middle region of the belt 12 than at the edges.

In the embodiment, this distribution of the openings 13 has the advantage of productively guiding any leakage air flow towards the low-resistance structure elements 30*b*, e.g., air leaking in between the support surface 14*a* and the underside of the belt 12. According to the embodiment, the continuous region 32*b* of the belt 12 is arranged between the regions 32*a* with openings 13*a* at the edge and openings 13*b* in the middle region of the belt 12. Thus, any leakage air flow streaming to a low-resistance region 31*b*, which is arranged below a continuous region 32*b* of the belt 12, contributes to the suction in the regions 32*a* with openings 13*a*, 13*b*, and thus to the holding force for flat pieces 11 above the openings 13*a*, 13*b*. In particular, the openings 13*a*, 13*b* of the belt 12 are arranged so close to each other that a leakage air flow will be drawn from these openings 13*a*, 13*b*. Thus, any leakage air flow is used productively, when a flat piece 11 is placed over the openings 13*a*, 13*b*.

The suction distributing structure 30 has several units, which comprise high-resistance 30*a* and low resistance structure elements 30*b*. These units of the suction distributing structure 30 extend essentially over the width Y of the support surface 14*a*. The units of the suction distributing structure 30 are regularly spaced at intervals Pi along the transport axis TA, in particular a distance Pi of the channels 30*a* to each other.

In the present embodiment, the length of the openings 13, 13*a*, 13*b* along the transport axis TA is the same in all cases.

In the embodiment, this length is chosen such that the openings 13, 13*a*, 13*b* do not connect two separate units of the suction distributing structure 30, in particular they do not connect two channels forming the high-resistance structure elements 30*a*. In particular, the length of an openings 13, 13*a*, 13*b* is smaller than the interval Pi between two units of the suction distributing structure 30. Thus, it is avoided that overly much pressure is lost through one openings 13, 13*a*, 13*b*, which is not covered by a flat piece 11 and thus allows an air inflow.

Also, the openings 13, 13*a*, 13*b* are arranged at intervals Po, in particular a specific distance Po between the trailing edges of the openings 13, 13*a*, 13*b*. This distance Po may correspond to or be equal to the length of the periodic unit Pu of FIG. 4A.

The pattern of openings 13, 13*a*, 13*b* of the belt 12 and the suction distributing structure 30 may also be periodic, in particular with a length Pp of the periodic pattern.

In the present embodiment, period length Pp is shorter than ⅓ of the length of a typically used flat piece 11. Due to the relation of periodic lengths Pi<Po, every periodic length Pp one opening 13 does not have a fluid connection to the suction distributing structure 30. By defining a predetermined periodic length Pp<<length of the flat piece 13, the flat piece 13 has only a minimal loss of suction at these disconnected openings 13, since the openings 13 is only disconnected for a very short period of time, in particular about 1 ms in the present case, depending on the transport speed of the belt 12 relative to the support element 14. With a ratio of Pp>>length of the flat piece 11, the suction force for a flat piece 11 on the belt 12 is essentially constant and only slightly reduced, when one of the openings 13 is disconnected from the suction distributing structure 30.

In another embodiment, a pattern of openings 13, 13*a*, 13*b* of the belt 12 and the suction distributing structure 30 may be provided, where there are no openings 13, 13*a*, 13*b* without a fluid connection to the suction distribution structure.

With reference to FIGS. 5A and 5B, the structure of a modular support element is described in more detail.

A base 22 is shown, which serves as a carrier for the further elements of the support element 14.

The support element 14 comprises several support element module 40. One of the support element modules 40 is shown missing, to make the structure of the system better visible.

The support element modules 40 have a flat support module surface 40*a*, such that their assembly forms a support surface 14*a* of the support element 14. When the device 10 is operated, the belt 12 is transported over the support surface 14*a*.

The support element modules 40 have an arc-like structure, so that a channel 15 is formed between the assembled support element 14 and the base 22, after fixating the support element modules 40 on the base 22.

To seal this channel 15 in relation to the environment, and to allow the provision of a vacuum suction through this channel 15, seals 44 are provided at the interfaces between support element modules 40 and the base 22, and seals 42 are provided between the support module end surface 40*b* at the end portions of the support element modules 40, respectively.

To fasten and secure the support element modules 40 in relation to the base 22, and to secure their position with respect to each other, bolts 23 are used.

The modular configuration of the support element 14 allows to easily exchange and/or modify and/or repair individual support element modules 40. This is especially useful, since the friction between the metal belt 12 and the support surface 14*a* may cause considerable wear of the surface and/or the suction distributing structure 30.

In the embodiment, three different types of support element modules 40 are provided, namely for providing a beginning section of the support element 14, where flat pieces 11 are fed onto the belt 12, a mid-section of the support element 14, over which the flat pieces 11 on the belt 12 are moved, and an end section of the support element 14, where the flat pieces 11 are removed from the belt 12. A support element module 40 for the mid-section may be used several times, depending on the overall length of the support element 14. The beginning section may be configured such that weaker suction is experienced by flat pieces 11 on a belt above the beginning section, to make sure that flat pieces 11 can be brought into a defined position before fixing the position for the transport on the belt 12.

Also, a longer support element 14 can easily be provided by using more modules 40, or a shorter support element 14 can be provided by using fewer modules 40 for the device 10.

In the present embodiment, the support element 14 can be manufactured by 3D-printing and subsequent treatment of the surfaces, e.g. by milling and/or drilling, in particular the support surface 14*a* and/or openings 17*a*.

For example, the support element 14 can comprise a polymer material.

In particular, milling can be used to provide the flat support surface 14*a* of the support element 14, in particular with the suction distributing structure 30.

In some systems of the art, shallow and wide channels have been used in the support surface 14*a* to distribute suction. Instead, the support element of the embodiment can be configured with relatively narrow and deep channels of the suction distributing structure 30, in order to provide a high-resistance structure element 30*a*. Such a channel design can allow manufacture with lower tolerances for the air flow. For example, a tolerance of +/−0.1 mm for the machining of a channel, a channel with 0.3 mm depth leads to ca.+/−30% deviation in air flow, which may affect an under-pressure that is generated by means of the channel. On the other hand, the tolerance of +/−0.1 mm for a channel at 1.2 mm depth leads to <10% variation in air flow.

The present design improves the holding force on flat pieces 11, which can be provided by the suction distributing structure 30 in combination with a suitable belt design: The belt 12 of the device 10 may have a width, which is smaller than the width of the flat pieces 11, in particular at least 60% of the width of the flat pieces 11 to be treated, preferably at least 75%, more preferably at least 85%. Thus, the flat pieces 11 on the belt 12 have a certain overhang over the edges. Thus, it is important to provide sufficient holding force in the middle of the width of the belt 12 to hold the flat pieces 11. In order to improve the holding force in the middle of the belt width, openings 13*b* may be provided in the middle region, corresponding to a high-resistance region 31*a* of the suction distributing structure 30 at the support surface 14*a* of the support element 14. For example, two rows of slots or openings 13 may be provided in the middle of the width of the support surface 14*a* relative to the transport axis TA.

Specifically, flat pieces 11 with an uneven surface, e.g., an uneven structure for providing Braille features for blind users, may pose significant challenges for a device 10 to hold a flat piece 11 by suction. The uneven surface may lead to a higher leakage of air into the openings 13 and a weaker sealing between the belt's transport surface 12*a* and the surface of the flat piece 11 is reached. Thus, higher suction may be necessary to hold such flat pieces 11.

Similarly, a higher suction may be needed to hold flat pieces 11 with a curvature, e.g., from embedded chips, a perforation, or with small security features or other irregularities of the surface, compared to flat pieces 11 with a perfectly flat surface in contact with the transport surface 12*a* of the belt 12.

The embodiment of the device 10 may, for example, be used in a printer, in particular an inkjet printer. Therein, the belt 12 is extending in such a way that the flat pieces 11 on the transport surface 12*a* are positioned below one or several print heads, where a printing operation is performed.

By providing suction to the belt 12 as well as the flat pieces 11 on the belt 12, a high precision is secured and, e.g., security features can be applied to the flat pieces 11 with high accuracy.

By transporting the belt 12 over the support surface 14*a*, while suction is applied through the suction distributing structure 30, high fiction between the belt 12 and the surface 14*a* is achieved, leading to lower variances in lateral position. At the same time, flat pieces 11 on the belt's 12 transport surface 12*a* are held steadily and at a fixed position relative to the belt 12.

In addition to or instead of printing, other treatments may be performed on the flat pieces 11, e.g., laser engraving, laminating, curing, programming of a chip, including further security features or similar.

REFERENCE NUMERALS

10 Device
11 Flat piece; plastic card
12 Belt
12*a* Transport surface
13 Opening
13*a* Opening (edge of the belt)
13*b* Opening (middle of the belt)
14 Support element
14*a* Support surface; top surface (or the support element)
15 Closed channel
16 Vacuum supply; connection to vacuum pump
17 Closed channel
17*a* Vacuum control hole; opening
18 Driven roller
20 Tensioned idler
22 Base
23 Bolt
24 Card ruler
30 Suction distributing structure
30*a* High-resistance structure element; narrow open channel
30*b* Low-resistance structure element; wide open channel; deepening
31*a* High-resistance region; Card suction region
31*b* Low-resistance region; Belt suction region
32*a* Region with openings
32*b* Continuous region
34 Air flow
40 Support element module
40*a* Support module surface
40*b* Support module end surface
42 Seal
44 Seal
A-A Sectional axis
TA Transport axis
Pi Distance of channels
Po Distance of openings
Pp Period of pattern (belt-support assembly)
Pu Periodic unit (belt openings)
Y Axis

The invention claimed is:

1. A device for conveying flat pieces, the device comprising:

a belt with a transport surface, wherein the belt is movable along a transport axis;

a support element with a support surface for supporting the belt; and a vacuum supply for providing vacuum suction;

wherein a suction distributing structure at the support surface of the support element is in fluid connection with the vacuum supply; and wherein the suction distributing structure has a belt suction region and a card suction region, wherein the belt suction region is configured to provide suction to the belt and the card suction region is configured to provide suction to flat pieces on the transport surface of the belt, and wherein the fluid connection with the vacuum supply in the belt suction region has a lower flow resistance than in the card suction region.

2. The device of claim 1, wherein the belt has openings that are configured such that, when the device is operated, the openings are arranged corresponding to the card suction region of the suction distributing structure.

3. The device of claim 2, wherein:

the openings are configured such that they have a pattern with periodic units that repeat periodically along the transport axis; and the periodic units are configured such that at least one opening of the periodic unit is arranged in fluid connection with the vacuum supply while the belt is transported over the support element.

4. The device of claim 2, wherein the belt has a continuous region that is arranged, when the device is operated, corresponding to the belt suction region of the suction distributing structure.

5. The device of claim 4, wherein the suction distributing structure comprises an elongated channel in the card suction region.

6. The device of claim 1, wherein the vacuum supply comprises a channel in the support element along the transport axis.

7. The device of claim 1, wherein the suction distributing structure comprises a channel with a varying cross-section area, wherein the cross-section area is lower in the card suction region than in the belt suction region.

8. The device of claim 1, wherein:

the fluid connection of the suction distributing structure with the vacuum supply comprises a first channel with a first cross-section for supplying the belt suction region and a second channel with a second cross-section for supplying the card suction region; and the second cross-section is smaller than the first cross-section.

9. The device of claim 1, wherein the flat pieces are plastic cards.

10. The device of claim 1, wherein the support element is formed by at least two support element modules.

* * * * *